United States Patent [19]

Kurozu et al.

[11] 4,073,519

[45] Feb. 14, 1978

[54] NOISELESS LATCH FOR PARTICULAR USE ON VEHICLE DOORS

[75] Inventors: Toshio Kurozu, Chigasaki; Yoshikazu Hamada, Tokyo, both of Japan

[73] Assignee: Mitsui Kinzoku Kogyo Kabushiki Kaisha, Tokyo, Japan

[21] Appl. No.: 676,612

[22] Filed: Apr. 13, 1976

[30] Foreign Application Priority Data

Dec. 26, 1975 Japan ..... 50-177775[U]

[51] Int. Cl.[2] ..... E05C 3/06; E05C 3/16

[52] U.S. Cl. ..... 292/216; 292/DIG. 56

[58] Field of Search ..... 292/216, DIG. 56, DIG. 25, 292/DIG. 39, 341.12, 341.13; 70/463

[56] References Cited

U.S. PATENT DOCUMENTS

| | | | |
|---|---|---|---|
| 1,060,019 | 4/1913 | Pederson | 292/216 |
| 1,194,636 | 8/1916 | Joy | 292/DIG. 56 |
| 3,171,677 | 3/1965 | Klove, Jr. et al. | 292/216 |
| 3,206,240 | 9/1965 | Roethel | 292/216 |
| 3,667,791 | 6/1972 | Kazaoka et al. | 292/216 |
| 3,767,243 | 10/1973 | Yoshimura | 292/216 |
| 3,809,416 | 5/1974 | Kazoaka | 292/216 |

*Primary Examiner*—Paul R. Gilliam
*Assistant Examiner*—Kenneth J. Dorner
*Attorney, Agent, or Firm*—Fitzpatrick, Cella, Harper & Scinto

[57] ABSTRACT

In a door latch system having a metal latching member engageable with a metal striker, a noise suppressor of resilient material is dovetail jointed to the latching member, in such a position thereon that the striker makes noiseless contact therewith upon closure of the door. The latch further comprises a stop of resilient material arranged for contact with the striker in a fully latched position, and a guide of relatively rigid, wear-resistant material extending along a striker guideway in the main body of the latch.

13 Claims, 17 Drawing Figures

NOISELESS LATCH FOR PARTICULAR USE ON VEHICLE DOORS

BACKGROUND OF THE INVENTION

This invention relates to latches and more particularly to a noiseless latch best adapted for use on the side doors of automobiles and like vehicles.

There has been known and used extensively a vehicle side door latch system consisting essentially of a latch installed in the door and a striker affixed to the vehicle body, with the latch and striker coacting to releasably retain the door in a closed position relative to the vehicle body. Typically, the latch comprises a latching member rotatably supported across a striker guideway in the main body or frame of the latch for engagement with the striker, a ratchet engageable with the latching member to inhibit its motion in one direction, and means for controllably actuating the ratchet into and of engagement with the latching member.

The prior art door latch system of the above outlined construction has problems arising from the fact that the latching member and striker, which make direct contact with each other, are both made of metal. Upon closure of the door, therefore, a harsh metallic sound is inevitably produced by the forceful contact between latching member and striker. Furthermore, the impact of a collision between the latching member and striker is usually such that an objectionably high, impact load is imparted to the latching member and other associated parts of the latch.

SUMMARY OF THE INVENTION

It is therefore an object of this invention to prevent the production of a harsh metallic sound upon contact between the latching member and striker of a door latch system.

Another object of the invention is to lessen the impact load imparted by the striker to the latching member and other associated parts.

With these and other objects in view this invention is directed, in brief, to a latch system of the type comprising a latching member rotatably supported across a striker guideway in the main body of the latch and having a recess for engagement with a striker, and means for controllably restraining the latching member from rotation in one direction. Characteristically, the invention provides the improvement which comprises a noise suppressor member of resilient material substantially integrally attached to the latching member so as to define part of the recess therein. The noise suppressor member is to positioned on the latching member as to be struck against by the striker upon entrance thereof into the striker guideway.

As will be apparent, the noise suppressor member of resilient material serves the dual purpose of noise suppression and shock absorption. The remaining portion of the latching member can be made of metal as usual, so that the latching member is capable of locking the striker against withdrawal as positively as the conventional latching member of metal throughout. Moreover, by suitable determination of the size of the noise suppressor member in relation to that of the striker, the latter can be resiliently engaged in the latching member recess without any play. It is an additional advantage that since the latching member does not make any violent metal-to-metal contact with the striker, its wear is minimized, thus contributing toward a longer life of the latch system.

The above and other objects, features and advantages of the invention will become more apparent and understandable from a consideration of the following description, with reference had to the accompanying drawings illustrating a preferred embodiment of the invention.

DETAILED DESCRIPTION

Figure 1:
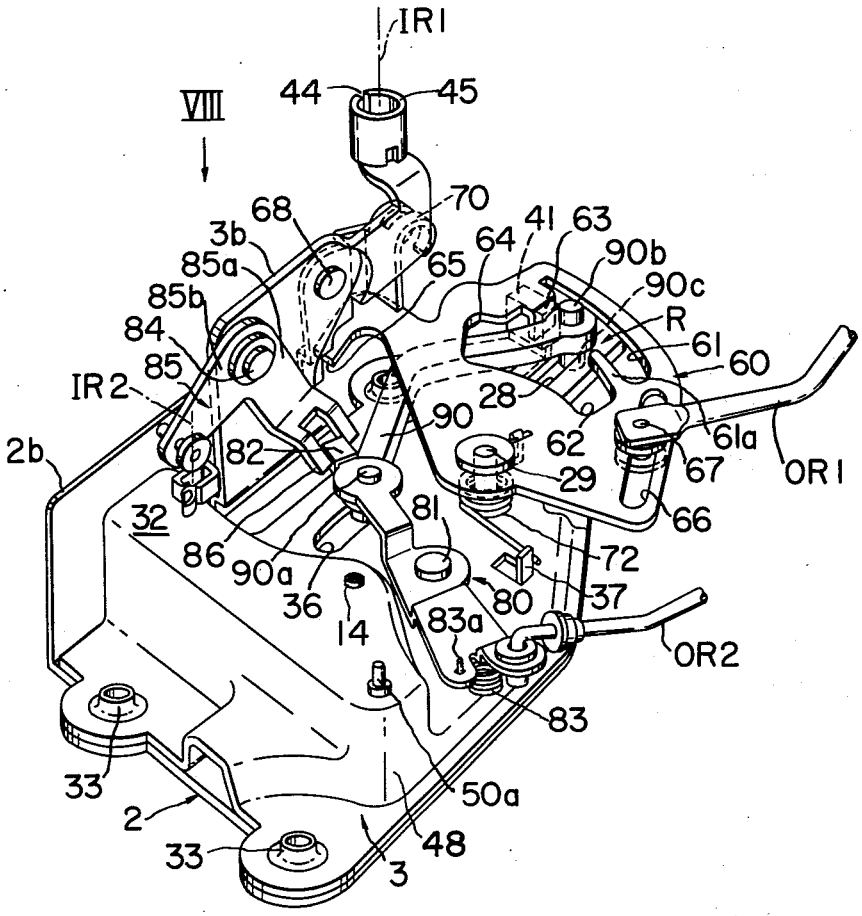
FIG. 1 is a perspective view of a latch embodying the principles of this invention.

As illustrated in its entirety in FIG. 1, a preferred form of the latch according to this invention includes a main body or frame comprising a cover plate 2 and a base plate 3. The cover plate 2 supports a latching mechanism between itself and the base plate, whereas the base plate supports thereon control or operating mechanism for the latching mechanism, as will be later described in more detail. These cover and base plates 2 and 3 are rigidly coupled to each other and, in an application of the latch to an automotive vehicle side door, are installed in the door.

Figure 2:
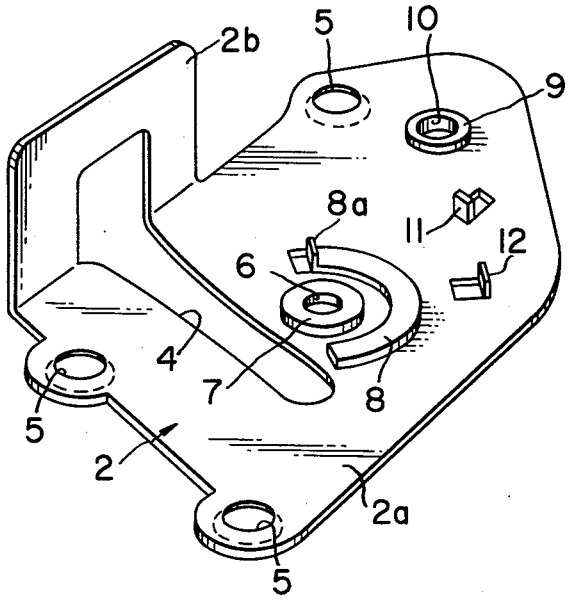
FIG. 2 is a perspective view of a cover plate constituting a part of the latch of FIG. 1.

As best shown in FIG. 2, the cover plate 2 integrally comprises a planar major portion 2*a* and an upstanding wallportion 2*b* on one of its lateral edges. These two plate portions are slotted at 4 to provide a guideway for an ordinary striker S (FIG. 8) with which the latch is designed to cooperate to retain the door in a closed position relative to the vehicle body or the like. The cover plate 2 has several mounting holes 5 for insertion of fastener elements therethrough. Formed approximately centrally through the cover plate 2 is another hole 6 for rotatably supporting a latching member L in the manner later described in connection with FIG. 3. The hole 6 is surrounded by a raised latching member seat 7 having a planar top surface, and an arcuate spring seat 8 also having a planar top surface is formed in the adjacency of the latching member seat in concentric relationship thereto. The spring seat 8 has an upstanding stop or retainer 8*a* at one of its ends. Further formed on the cover plate 2 are a raised annular ratchet seat 9 surrounding a hole 10 for rotatably or pivotally supporting a detent or ratchet R as shown in FIG. 3, and two upstanding stops 11 and 12.

Figure 3:
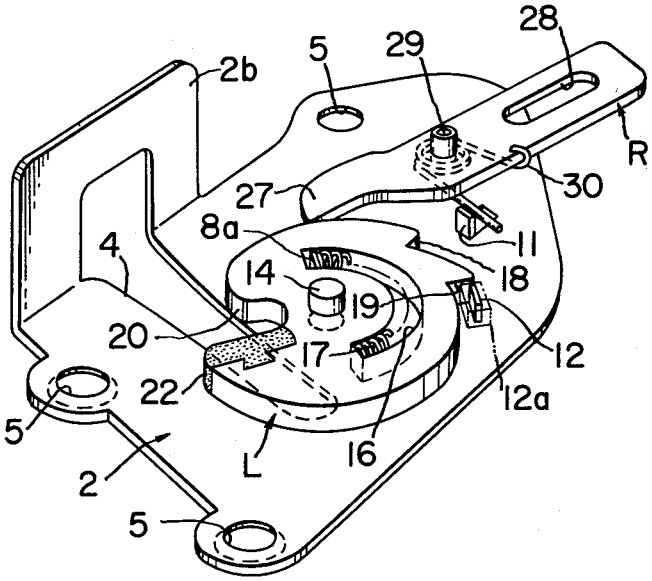
FIG. 3 is a perspective view of the cover plate of FIG. 2 together with a latching member and a ratchet mounted in position thereon.

With reference to FIG. 3, the cover plate 2 has mounted thereon the latching member L and the ratchet R which can both be made of metal. The latching member L is rotatably supported by a shaft 14 received in the hole 6 and slidably rests on the latching member seat 7.

Figure 4:
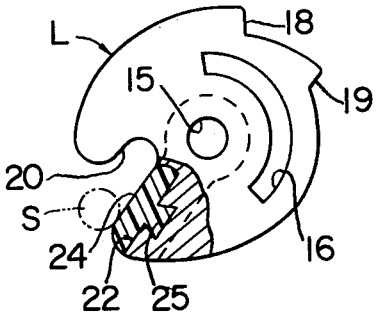
FIG. 4 is a plan view, partly in section, of the latching member of FIG. 3.
Figure 5:
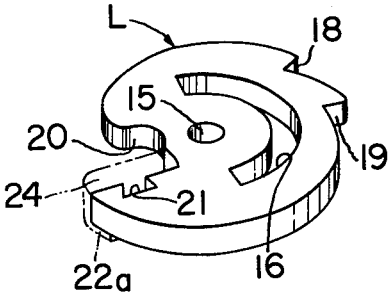
FIG. 5 is an exploded perspective view of the latching member, the view showing a noise suppressor member as disassembled from the latching member.
Figure 5:
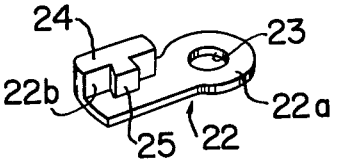

As is apparent also from FIGS. 4 and 5, the latching member L has formed therein an arcuate slot 16 having its center coinciding with the axis of its mounting hole 15 through which extends the shaft 14. Operatively accommodated in this slot 16 is a helical compression spring 17 (FIG. 3) having its opposite ends abutting against the aforesaid stop 8*a* and one of the ends of the slot. The latching member L is therefore biased to turn clockwise as viewed in FIG. 3. The latching member L is peripherally provided with two ratchet teeth having abutments 18 and 19. The abutment 19 is normally urged against a cushioning member 12*a* fitted over the stop 12 to limit the clockwise turn of the latching member.

The member L is recessed at 20 as usual for engagement with the striker. According to the novel concept of this invention, as best seen in FIGS. 4 and 5, that wall portion of the recess 20 of the metal latching member L against which the striker first comes into abutment upon closure of the door is cut out with suitable dimensions, and a groove of dovetail cross section 21 is further formed in the latching member so as to extend in the direction of its axis of rotation. Installed in this cut out portion of the latching member L is a noise suppressor member 22 of relatively resilient material such as, for example, polyurethane resin. As shown also in FIG. 5, the noise suppressor member 22 integrally comprises a mounting plate 22*a* and a noise suppressor proper 22*b* formed thereon. The mounting plate 22*a* has a hole 23 formed at its end remote from the noise suppressor proper 22*b*. The noise suppressor proper can be subdivided into a major portion 24 and a tenon 25 of dovetail cross section.

For installation of the noise suppressor member 22, its mounting plate 22*a* is placed on the back surface of the latching member L, with the hole 23 disposed in register with the hole 15 of the member L to receive the shaft 14, and the tenon 25 is snugly fitted in the groove 21. Thus, the recess 20 of the latching member L is bounded in part by the noise suppressor proper of the noise suppressor member 22. It will be appreciated that the noise suppressor member 22 is dually secured to the latching member L, by the mounting plate 22*a* held on the back surface of the member and by the devetail joint constituted by the interfitting groove 21 and tenon 25.

Referring back to FIG. 3, the ratchet R terminates at one end at a pawl 27 for selective engagement with the abutments 18 and 19 on the latching member L and has at the other end a guide slot 28 extending in its longitudinal direction. The ratchet R is pivotally supported by a shaft 29 received in the hole 10 of the cover plate 2 and is biased in the counterclockwise direction, as viewed in FIG. 3, by means of a torsion spring 30 coiled around the shaft 29. One end of this spring 30 is hooked to engage the ratchet R, whereas the other end of the spring is stopped and held by the stop 12 on the cover plate 2.

Figure 6:
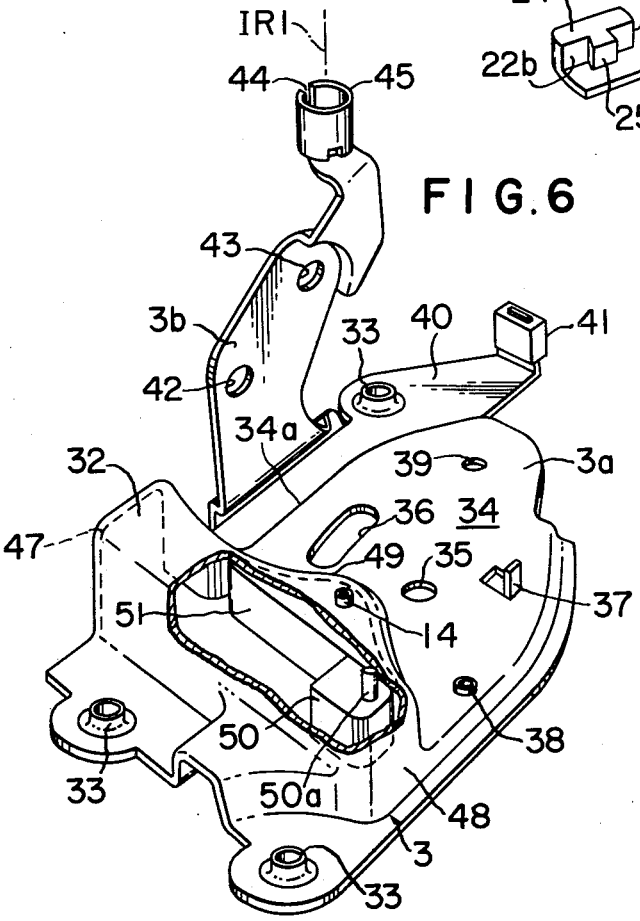
FIG. 6 is a perspective view of a base plate constituting a part of the latch of FIG. 1, the base plate being shown partly broken away to reveal a resilient stop and a striker guide in their working positions.

FIG. 6 best illustrates the configuration of the base plate 3 adapted to accommodate the latching member L, the ratchet R and the other associated parts between itself and the cover plate 2. The base plate 3 essentially comprises a major portion 3*a* which is of a shape and size to substantially fit over the cover plate 2, and an upright portion 3*b* formed on one side of the major portion. The major portion 3*a* of the base plate has a hollow, raised portion 32 of substantially inverted-U-shaped cross section arranged in register with the slot 4 in the cover plate 2 for defining the aforesaid striker guideway. Mounting holes 33 are formed in the base plate major portion 3*a* so as to be in register with the mounting holes 5 in the cover plate 2, so that the cover plate and base plate can be secured to each other by suitable fastener elements inserted into their aligned mounting holes 5 and 33. Most of the base plate major portion 3*a* is slightly raised, as indicated at 34, to provide a space for accommodating the latching member L, the ratchet R and so forth. The slightly raised portion 34 is bounded in part by an upstanding side wall 34*a*.

The base plate major portion 3*a* further comprises a hole 35, an arcuate guide slot 36 having its center at the axis of the hole 35, a spring retainer 37, and holes 38 and 39, which are all arranged on its slightly raised portion 34 for purposes hereinafter made apparent. The base plate major portion 3*a* has an extension 40 securely carrying at its remote end a shock absorbing member 41 of plastics, rubber or like material.

The upright portion 3*b* of the base plate 3 has formed therein two holes 42 and 43 and is integrally provided with a tubular portion 45 which is slit at 44.

The hollow, raised portion 32 of the base plate is open at its end 47, which is to be placed against the wall portion 2*b* of the cover plate 2 in the completed latch as shown in FIG. 1, and is closed at the other end 48. The raised portion 32 has a substantially triangular expansion 49, which is also hollow, on one of its sides. Housed in the raised portion 32, in direct contact with its closed end 48, is a stop 50 of rubber or like resilient material which has a suitably great dimension in the direction perpendicular to the general plane of the base plate 3.

Within the triangular expansion 489 of the raised portion 32 there is neatly disposed a striker guide 51 of corresponding shape which can be formed of relatively rigid, wear-resisting material such for example as polyacetal resin. This striker guide 51 should be only sufficiently thick to leave a space for accommodating the latching member L between itself and the cover plate 2, as will be seen from a consideration of FIG. 7.

Figure 7:
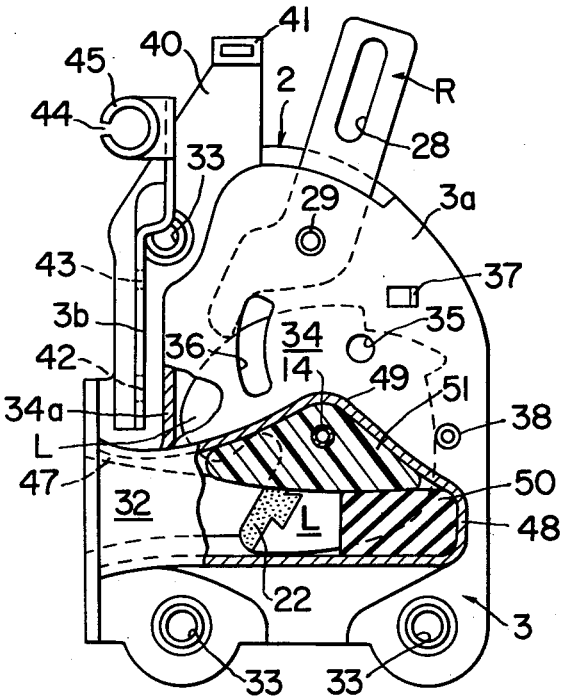
FIG. 7 is a plan view showing the cover plate of FIG. 2 and the base plate of FIG. 6 in assembled form together with the latching member, ratchet and so forth, the base plate being shown partly broken away to reveal the inner details.

As will be noted also from FIG. 7, the hole 39 in the base plate 3 receives the shaft 29 pivotally supporting the ratchet R when the base and cover plates are fitted against each other. The stop 50 is secured in position within the raised portion 32 by a pin 50*a* (FIG. 6) inserted into and through a hole, not shown, in the raised portion, the pin being formed integral with the stop 50. The striker guide 51 is secured in position within the triangular expansion 49 by the shaft 14 for the latching member extending therethrough.

It will be further observed from FIG. 7 that the aforesaid side wall 34*a* bounding part of the slightly raised portion 34 of the base plate 3 is positioned with a slight spacing from the latching member L. This wall is designed to serve as an abutment against which the latching member L will bear when the member is loaded in excess of a certain degrree in the direction of withdrawal of the striker away from the striker guideway. Thus, although the latching member L is weakened to some decrease in strength because of the arcuate slot 16 formed therethrough, it can be safeguarded by the wall 34*a* against formation or radial cracks therein via the arcuate slot during operation of the latch under impact conditions.

Reference is now directed back to FIG. 1 to describe various means mounted on the base plate 3 for control of the ratchet R and related parts. A release lever 60 is pivotally mounted on the projecting end of the shaft 29 pivotally supporting the ratchet R. This release lever 60 has substantially parallel first and second substantially arcuate slots or openings 61 and 62 disposed about the axis of the shaft 29. The two openings mosly communicating with each other, being separated only by a projecting part 61*a* of the release lever 60. The first opening 61 has at or adjacent its left hand end, as viewed in FIG. 1, an abutment 63 formed by bending a part of the release lever 60 toward the base plate 3. The left hand end of the second opening 62 is recessed at 64, the recess being located on the left hand side of the notional line passing through the axis of the shaft 29 and the abutment 63.

The release lever 60 further comprises a tongue 65 at its left hand end and a slot 66 adjacent its right hand end. A pin 67 is passed within the slot 66 for sliding movement therealong and is coupled to one end of a release rod $OR_1$ for use in releasing the latch from outside the vehicle.

Figure 8:
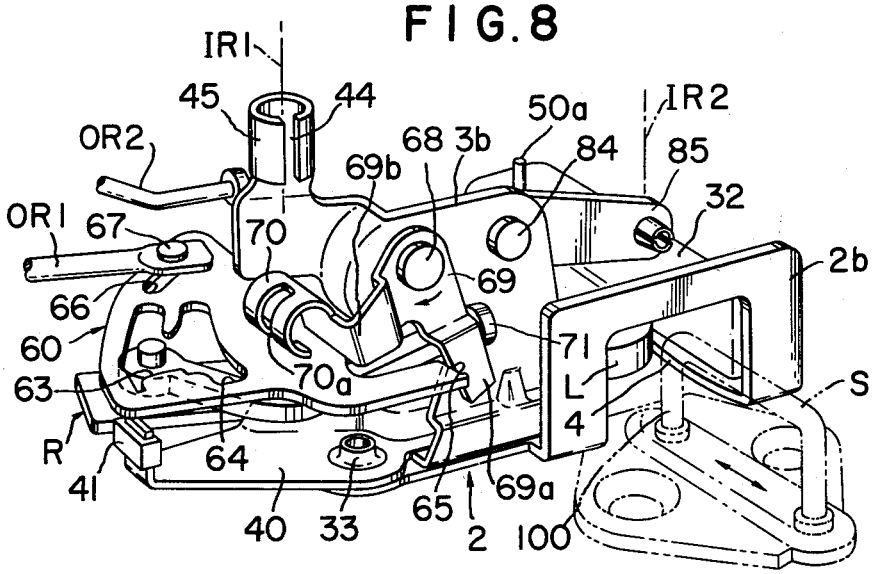
FIG. 8 is a perspective view of the complete latch as seen in the direction of the arrow VIII in FIG. 1, the view also showing a phantom striker with which the latch is designed to cooperate.

As will be seen also from FIG. 8, the tongue 65 of the release lever 60 is of such extent as to underlie the portion 3*b* of the base plate 3. A bell crank 69 is pivotally mounted on this portion 3*b* by a rivet 68 passing through the hole 43 (FIG. 6) in the portion. The bell crank 69 has its arm 69*a* arranged for engagement with the tongue 65 of the release lever 60, whereas the other arm 69*b* of the bell crank terminates in a tubular portion 70 having a cicumferential slot 70*a* formed centrally therein. A stop 71 formed on the portion 3*b* of the base plate 3 limits the counterclockwise turn, as viewed in FIG. 8, of the bell crank 69. The tubular portion 70 of the bell crank is operatively connected to a suitable linkage $IR_1$ which extends through the portion 45 as indicated by the dot-and-dash line in the figure and through which the latch can be released from inside the vehicle.

A torsion spring 72 is coiled around the shaft 29 pivotally supporting the ratchet R and the release lever 60, as shown in FIG. 1, and one end of this torsion spring 72 is hooked to engage the release lever 60 while the other end thereof abuts against the spring retainer 37 on the slightly raised portion 34 of the base plate 3. The release lever 60 is therefore biased by the torsion spring 72 to turn counterclockwise as viewed in FIG. 1, so that the abutment 63 of the release lever is normally urged against the shock absorbing member 41 on the extension 40 of the base plate major portion 3*a*. The release lever 60 can be turned clockwise against the bias of the torsion spring 72 either upon actuation of the release rod $OR_1$ in that direction or upon exertion of an upward pull, as viewed in FIG. 8, on the arm 69*b* of the bell crank 69 via the linkage $IR_1$.

As shown also in FIG. 1, a locking lever 80 is pivotally supported by a riveted pin 81 inserted into the hole 35 (FIG. 6) in the base plate major portion 3*a*. The locking lever 80 has at its left hand end a portion 82 which has a covering of nylon or like materials installed thereon, whereas the right hand end of the locking lever 80 is operatively connected to a locking rod $OR_2$ for use in locking the latch from outside the vehicle. This right hand end of the locking lever 80 is also engaged by one end 83*a* of an over-center spring 83 (i.e., a spring exerting a force reversed in direction beyond a predetermined "dead-center" position) the other end of which engages the hole 38 (FIG. 6) in the base plate major portion 3*a*. The locking lever 80 can thus be selectively retained either in a nonlocking position, as in FIG. 1, or in a locking position which is displaced a certain angle in the counterclockwise direction from the nonlocking position. The locking lever is unable to stop anywhere between the nonlocking and locking positions.

A second bell crank 85 is pivotally mounted on the portion 3*b* of the base plate 3 by a rivet 84 passing through the hole 42 (FIG. 6) formed therein. The second bell crank has its arm 85*a* bifurcated at 86 for engagement with the end 82 of the locking lever 80. The other arm 85*b* of the second bell crank is connected at its tip to a locking linkage, shown by the dot-and-dash line $IR_2$ in FIG. 1, for use in locking the latch from inside the vehicle. The aforesaid locking lever 80 can therefore be pivoted from its illustrated nonlocking to locking position upon actuation of either the locking rod $OR_2$ or the locking linkage $IR_2$.

A link 90 is pivotally connected at one end to the locking lever 80 in the adjacency of its end 82. Said one end of the link 90 is formed integral with a pin 90*a* which, on the other hand, is slidably or rotatably received in a hole in the locking lever 80 and which, on the other hand, is slidably engaged in the arcuate guide slot 36 in the base plate major portion 3*a*. With the pivotal movement of the locking lever 80 about the pin 81, therefore, said one end of the link 90 moves along the guide slot 36.

The other end of the link 90 also has an integral pin consisting of an upper portion 90*b* and a lower portion 90*c*. The upper pin portion 90*b* projects into the substantially arcuate opening 61 in the release lever 60, whereas the lower pin portion 90*c* is slidably received in the longitudinal guide slot 28 of the ratchet R best shown in FIG. 3.

Figure 9:
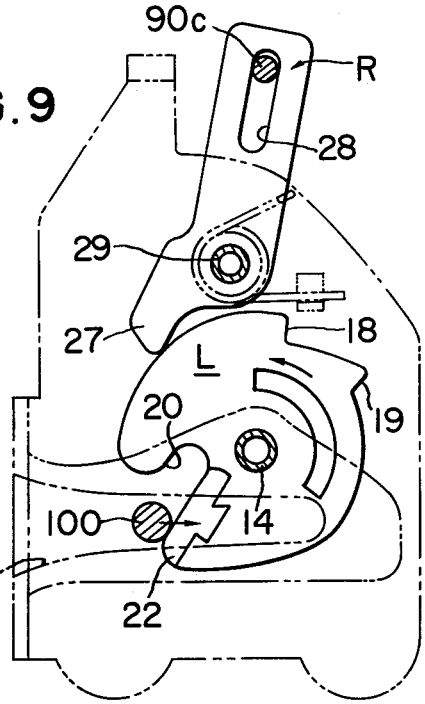
FIG. 9 is a schematic plan view of explanatory nature showing the latch in its normal or unlatched condition.

The operation of the above described latch is as follows:

FIG. 9 depicts the latch in its normal or released condition, where the latching member L has its recess 20 largely directed toward the entrance portion of the striker guideway defined in part by the slot 4 in the cover plate 2. To facilitate description, the striker S is assumed to move relative to the latch in the following description ofoperation, even though in fact the latch moves relative to the stationary striker.

As the striker S advances along the striker guideway of the latch, the leading engaging portion 100 of the striker first comes into contact with the noise suppressor member 22 defining part of the recess 20 in the latching member L, as represented in FIG. 9. The latching member is thus turned counterclockwise by the striker, as indicated by the arrow in FIG. 9. It should be noted that hardly any noise is produced upon forced contact of the striker with the latching member owing to the provision of the noise suppressor member 22 according to this invention.

Figure 10:
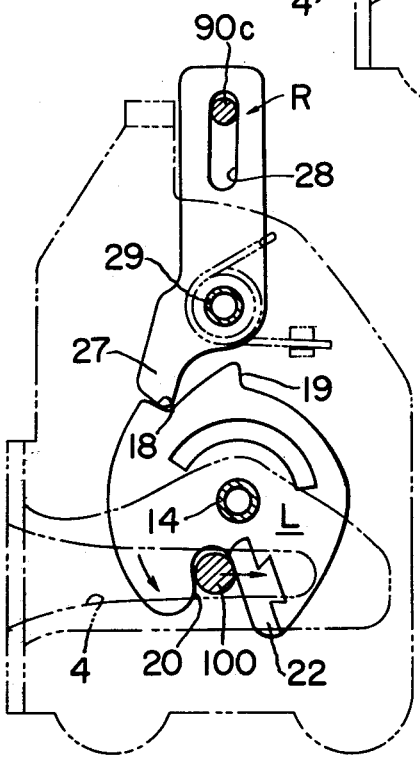
FIG. 10 is a view similar to FIG. 9 but showing the latch in a semi-latched position with respect to the striker.

With the further advance of the striker S and, consequently, with the continued counterclockwise turn of the latching member L, the so-called semi-latched position is realized as represented in FIG. 10. In this semi-latched position the pawl 27 of the ratchet R engages the abutment 18 on the latching member L to restrain the striker S from withdrawal out of the latch. As the striker S travels further forwardly along the guideway, there is obtained the so-called fully latched position represented in FIG. 11, in which the pawl 27 of the ratchet R engages the abutment 19 on the latching member L. In this fully latched position the engaging portion 100 of the striker abuts against the stop 50 of resilient material disposed in the raised portion 32 of the base plate 3 and is retained within the recess 20 of the latching member by causing some compression of the resilient stop 50.

Figure 12:
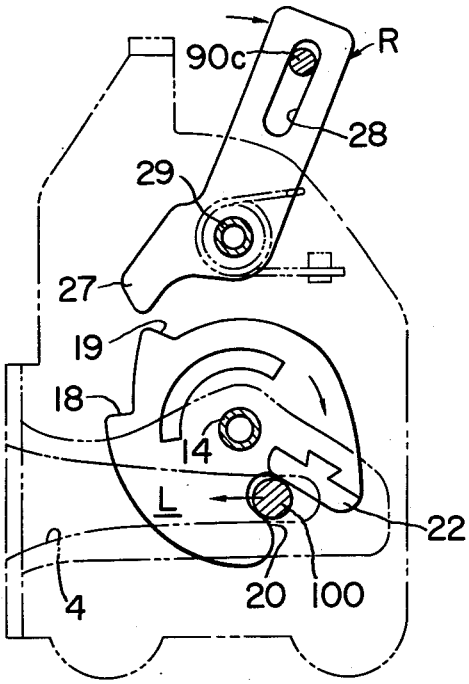
FIG. 12 is also a similar view showing the ratchet turned out of engagement with the latching member while the striker is shown still caught in the fully latched position.

For releasing the striker that has been caught in the fully latched position, the ratchet R may be turned clockwise relative to the main body of the latch, as indicated by the arrow in FIG. 12. Upon clockwise turn of the ratchet, its pawl 27 is disengaged from the abutment 19 on the latching member L, so that the member becomes free to turn clockwise, also as indicated by the arrow in FIG. 12. The striker portion 100, disengaged from the latching member is now movable toward the entrance end of the guideway.

Figure 13:
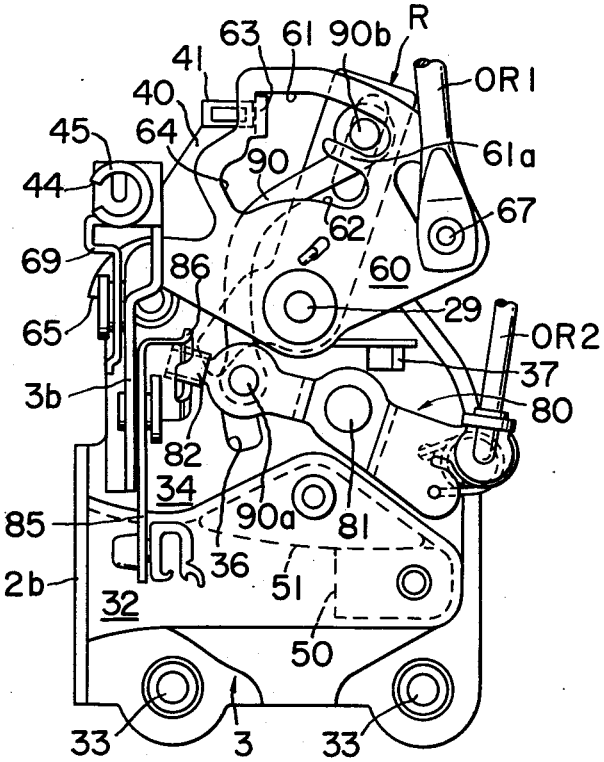
FIG. 13 is a plan view showing ratchet control mechanism of the latch in a condition corresponding to that of FIG. 9.

Illustrated in detail in FIG. 13 is the condition assumed by the ratchet control mechanism when the striker is released from the latch as in FIG. 9. In this condition the locking lever 80 is in its nonlocking position, where the end 82 of the locking lever is held closer to the release lever 60, and the upper pin portion 90*b* of the link 90 is disposed at the right hand end of the opening 61 in the release lever.

Figure 14:
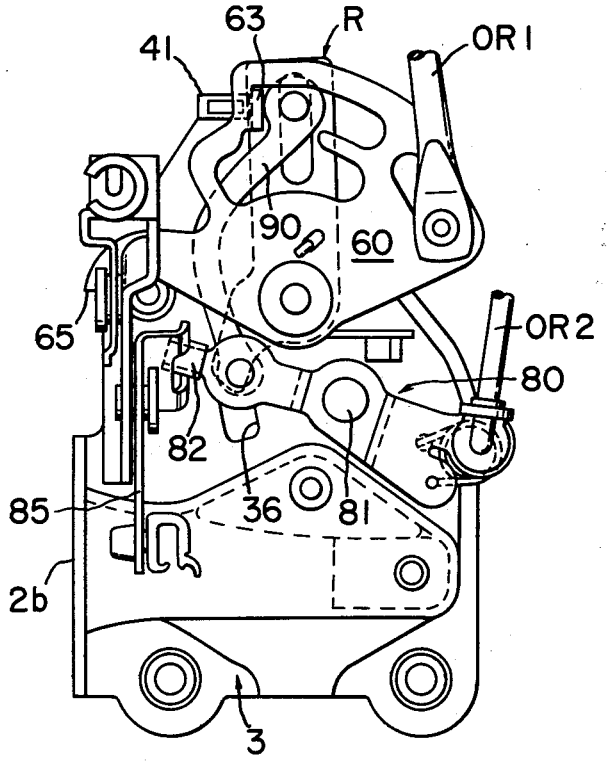
FIG. 14 is a view similar to FIG. 13 but showing the ratchet control mechanism in a condition corresponding to that of FIG. 10.

FIG. 14 is a similar illustration of the ratchet control mechanism in the condition corresponding to the semi-latched position of FIG. 10. The ratchet R is turned counterclockwise from its position shown in FIG. 9 or 13 and is held in abutting contact, at the left hand edge of its free end portion, with the shock absorbing member 41 on the extension 40 of the base plate major portion 3*a*. The link 90 is also turned counterclockwise from its previous position of FIG. 13.

Figure 11:
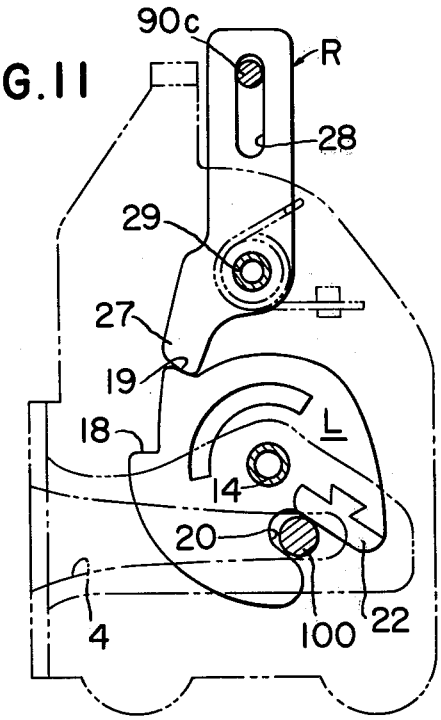
FIG. 11 is a similar view showing the latch in a fully latched position with respect to the striker.

The condition of the ratchet control mechanism represented in FIG. 14 remains unchanged after the latch shifts from the semi-latched position of FIG. 10 to the fully latched position shown in FIG. 11.

Figure 15:
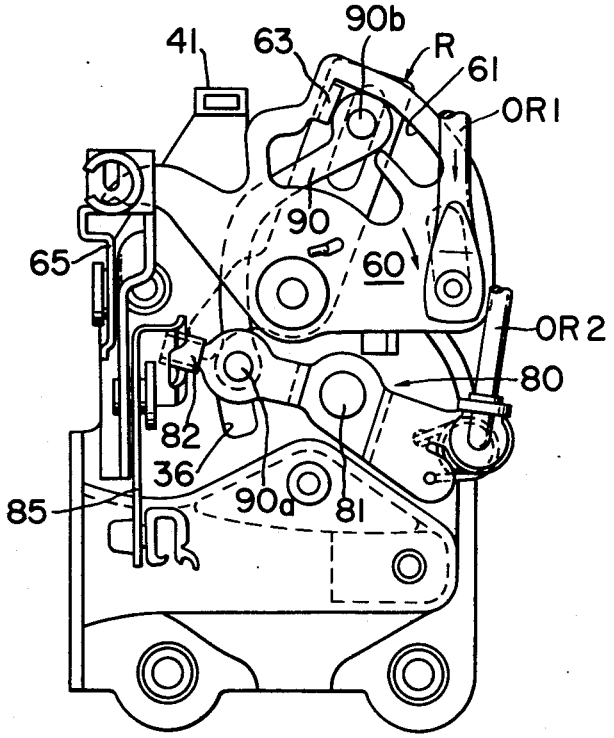
FIG. 15 is also a view similar to FIG. 13 but showing the ratchet control mechanism in a condition corresponding to that of FIG. 12.

As illustrated in detail in FIG. 15, the release rod $OR_1$ is actuated in the arrow marked direction from outside the vehicle, or the release linkage $IR_1$ shown in FIGS. 1 and 8 is acutated away from the main body of the latch from inside the vehicle, for releasing the striker as shown in FIG. 12. The release lever 60 is thereupon turned clockwise against the bias of the torsion spring 72 (FIG. 1) with the result that the link 90 is als turned clockwise about the pin 90*a* via the abutment 63 of the release lever. Since the pin portion 90*c* (FIG. 1) of the link 90 is slidably received in the slot 23 in the ratchet R, this ratchet is turned clockwise with the link 90 to disengage its pawl 27 from the abutment 19 on the latching member L. The striker S can now be released from the latching member L.

Upon release of the operating force that has been exerted on either the release rod $OR_1$ or the release linkage $IR_1$, the release lever 16 can be returned to the position of FIG. 13 under the bias of the torsion spring 72. The initial unlatched condition is thus obtained.

Figure 16:
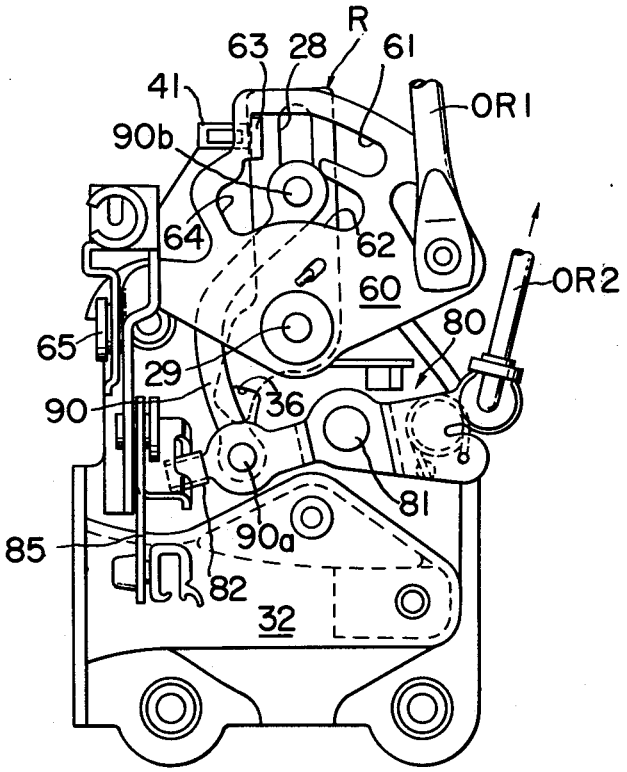
FIG. 16 is also a similar view explanatory of the way the latch is locked in the fully latched position.

The foregoing description of operation has been made on the assumption that the locking lever 80 is held in the aforesaid nonlocking position. For locking the door with the striker engaged by the latching in the fully latched position, the locking lever 80 is turned counterclockwise to the locking position as shown in FIG. 16. To this end, the locking rod $OR_2$ is actuated in the arrow marked direction from outside the vehicle, or the locking linkage $IR_2$ shown in FIGS. 1 and 8 is actuated in the direction away from the main body of the latch from inside the vehicle.

Upon actuation of either of the locking rod $OR_2$ and the locking linkage $IR_2$, the locking lever 80 is first turned counterclockwise against the bias of the overcenter spring 83, but beyond the aforementioned dead center position, this spring operates to urge the locking lever to the locking position of FIG. 16. Simultaneously, the link 90 is displaced to the illustrated position closer to the raised portion 32 of the base plate major portion 3*a* via the pin 90*a* at one end of the link. With this displacement of the link 90, the pin portion 90*c* at the other end of the link 90 slides along the guide slot 28 in the ratchet R, with the result that the other pin portion 90*b* at said other end of the link shifts from within the opening 61 into the opening 62 in the release lever 60.

Figure 17:
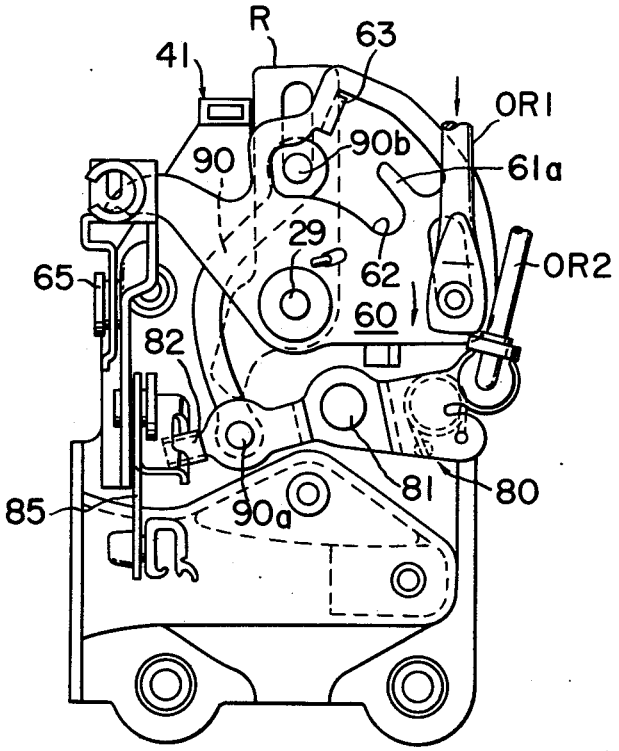
FIG. 17 is also a similar view explanatory of the locking feature of the latch.

Let it be assumed that the release lever 60 is now turned clockwise either by the release rod $OR_1$ or by the release linkage $IR_1$, in an attempt to unlatch the door. The pin portion 90*b* at said other end of the link 90 is received in the recess 64 at the left hand end of the opening 62 in the release lever 60 upon clockwise turn of the release lever to the position shown in FIG. 17. Since the recess 64 is located on the left hand side of the notional line passing the axis of the shaft 29 and the abutment 63, as previously mentioned, the link 90 does not follow the clockwise turn of the release lever 60. The latching member L and the ratchet R can thus be retained in their relative positions of FIG. 11 to hold the striker S in the fully latched position.

It is impossible to actuate the locking lever 80 to the locking position of FIG. 16 when the door is open, that is, when the latch is in the condition represented in FIG. 13. Even if the locking rod $OR_2$ or locking linkage $IR_2$ is actuated, the pin portion 90*b* on the link 90 will be prevented from shifting from within the opening 61 into the other opening 62 in the release 60 by the intervening projection 61*a* therebetween, so that the locking lever 80 will be retained in the position of FIG. 13.

While the invention has been shown and described in terms of a specific embodiment, it will be apparent that the invention itself is not to be restricted by the exact showing of the accompanying drawings or the description thereof.

What is claimed is:

1. A latch comprising a main body defining therein a striker guideway into and out of which a striker is movable, a latching member rotatably disposed across the striker guideway within the main body and having a recess for engagement with the striker, means for controllably restraining the latching member from rotation in one direction, a shaft rotatably supporting the latching member, and a noise suppressor member of resilient material substantially integrally attached to the latching member so as to define part of the recess, said noise suppressor member being so arranged on the latching member as to collide with the striker upon entrance thereon into the striker guideway, said noise suppressor member comprising a mounting plate having a hole for receiving said shaft and a noise suppressor proper formed integral with the mounting plate and secured directly to the latching member.

2. The latch as clamed in claim 1 wherein the noise suppressor proper is secured to the latching member by means of a dovetail joint.

3. The latch as claimed in claim 1 wherein the striker guideway has an entrance end and an opposite end, the striker being caught near said opposite end of the striker guideway when fully engaged by the latching member, and wherein a stop of resilient material is disposed at said opposite end of the striker guideway so as to be compressed by the striker when same is fully engaged by the latching member.

4. The latch as claimed in claim 1, further comprising a guide of relatively rigid, wear-resisting material disposed along the striker guideway.

5. The latch as claimed in claim 1 wherein said main body is formed with a wall disposed closely adjacent to said latching member at a position to bear the latching member when the striker engaging the recess of the latching member exerts excessive forces urging the latching member in a general direction in which the striker moves out of the guideway.

6. The latch as claimed in claim 5 wherein said main body has an outwardly bulged portion providing a space for accommodating the latching member, and said wall is a side wall of the bulged portion.

7. The latch as claimed in claim 1, further including means for resiliently urging said latching member in said one direction, said means comprising an arcuate slot means formed in the latching member, spring retainer means formed on said main body and slidably engaging the arcuate slot, and spring means disposed in the arcuate slot and abutting the spring retainer at its one end and one end of the arcuate slot at its other end.

8. The latch as claimed in claim 7 wherein said spring means is a compression coil spring.

9. The latch as claimed in claim 7 wherein said spring means is fully enclosed in said arcuate slot.

10. The latch as claimed in claim 1, wherein said mounting plate extends along and in contact with one surface of the latching member.

11. A latch comprising a main body defining therein a striker guideway into and out of which a striker is movable, a metal latching member mounted within said main body in a manner rotatable about a rotating axis, said latching member being disposed across the striker guideway and having a recess for engagement with the striker, said recess having a cutout, receding from the contour of the recess, along only one side part thereof with which the striker is in contact during its advance into and along the striker guideway, a swingable ratchet member having a pawl engageable with the latching member to controllably restrain the latching member from rotation in one direction, and a noise suppressor member of resilient material immovably fitted in said cutout so as to define the contour of the recess along said side part of the recess, said noise suppressor member extending over the full dimension of the latching member with respect to the direction of said rotation axis.

12. The latch as claimed in claim 11, further including a stop provided in said main body to prevent rotation of said latching member beyond a predetermined limit in said one direction, said stop being fitted thereon with a resilient cushioning member 13. The latch as claimed in claim 1, further including a resilient shock absorbing stop member provided on said main body to prevent said ratchet member from swinging beyond a predetermined limit in a direction such that the pawl moves into engagement with the latching member.

* * * * *

UNITED STATES PATENT AND TRADEMARK OFFICE

CERTIFICATE OF CORRECTION

PATENT NO. : 4,073,519

DATED : February 14, 1978

INVENTOR(S) : TOSHIO KUROZU, ET AL

It is certified that error appears in the above-identified patent and that said Letters Patent are hereby corrected as shown below:

| Col. | Line | |
|---|---|---|
| 1 | 53 | "to" (first occurrence) should read --so-- |
| 4 | 64 | "489" should read --49-- |
| 5 | 20 | "degrree" should read --degree-- |
| 5 | 25 | "or" should read --of-- |
| 8 | 6 | "als" should read --also-- |
| 8 | 8 | "slot 23" should read --slot 28-- |
| 8 | 21 | "latching" should read --latch-- |
| 10 | 40 | "l" should read --ll-- |

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*